United States Patent [19]

Murphy et al.

[11] 4,241,588

[45] Dec. 30, 1980

[54] ENERGY CONSERVING WATER HEATING SYSTEM

[76] Inventors: Jimmy Murphy, Rte. 6, Sunnybelle Acres, Thomasville, Ga. 31792; Ansley R. Fleetwood, 4206 Lone Oak Rd., Nashville, Tenn. 37215

[21] Appl. No.: 28,901

[22] Filed: Apr. 10, 1979

[30] Foreign Application Priority Data

Mar. 15, 1978 [SE] Sweden ..... 7802982

[51] Int. Cl.[3] ..... F25B 27/02

[52] U.S. Cl. ..... 62/238 E; 165/DIG. 2

[58] Field of Search ..... 62/238 E; 165/DIG. 2, 165/105

[56] References Cited

U.S. PATENT DOCUMENTS

| | | | |
|---|---|---|---|
| 2,125,842 | 8/1938 | Eggleston | 62/238 E |
| 2,375,157 | 5/1945 | Wilkes et al. | 62/238 E |
| 3,922,876 | 12/1975 | Wetherington, Jr. et al. | 62/238 E |
| 3,986,344 | 10/1976 | Newman | 62/238 E |
| 3,999,709 | 12/1976 | Estabrook | 165/DIG. 2 |
| 4,037,786 | 7/1977 | Munroe | 165/105 |
| 4,100,763 | 7/1978 | Brody | 62/238 E |
| 4,141,222 | 2/1979 | Ritchie | 62/238 E |
| 4,142,379 | 3/1979 | Kuklinski | 62/238 E |
| 4,146,089 | 3/1979 | Mueller et al. | 62/238 E |
| 4,173,125 | 11/1979 | Bradshaw | 62/238 E |

*Primary Examiner*—Lloyd L. King

*Attorney, Agent, or Firm*—B. P. Fishburne, Jr.

[57] ABSTRACT

Incoming cold water is delivered to a storage tank upstream from the customary domestic hot water heater. Waste heat recovery coils are located in the furnace flue and on the outlet of an air conditioning condenser unit. A system pump upstream from the water heater and between it and the storage tank circulates water from the storage tank through the two coils and back into the water inlet line leading to the water heater in a preheated state enabling the thermostatic setting of the water heater to be set at a significantly lower level than is customary.

2 Claims, 5 Drawing Figures

FIG. 1
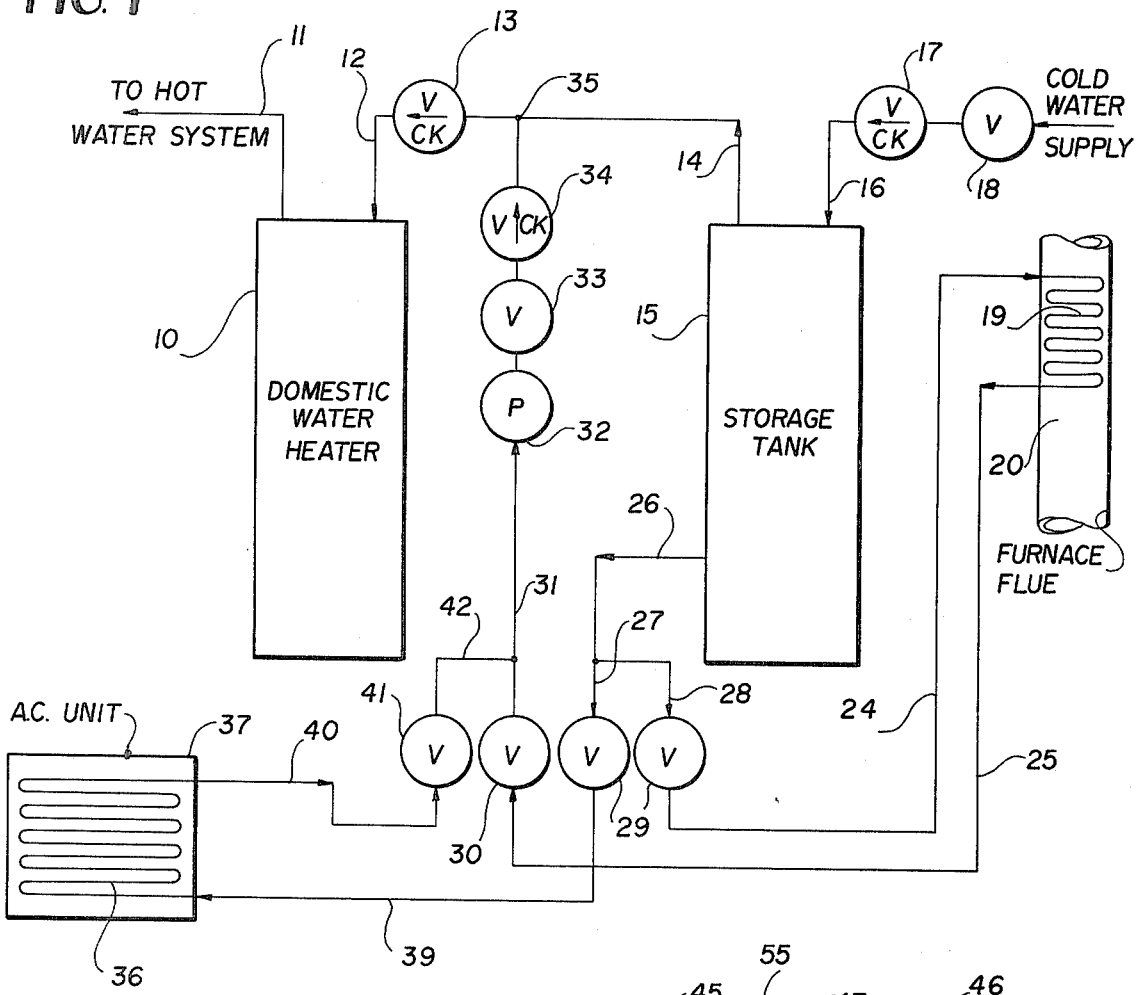
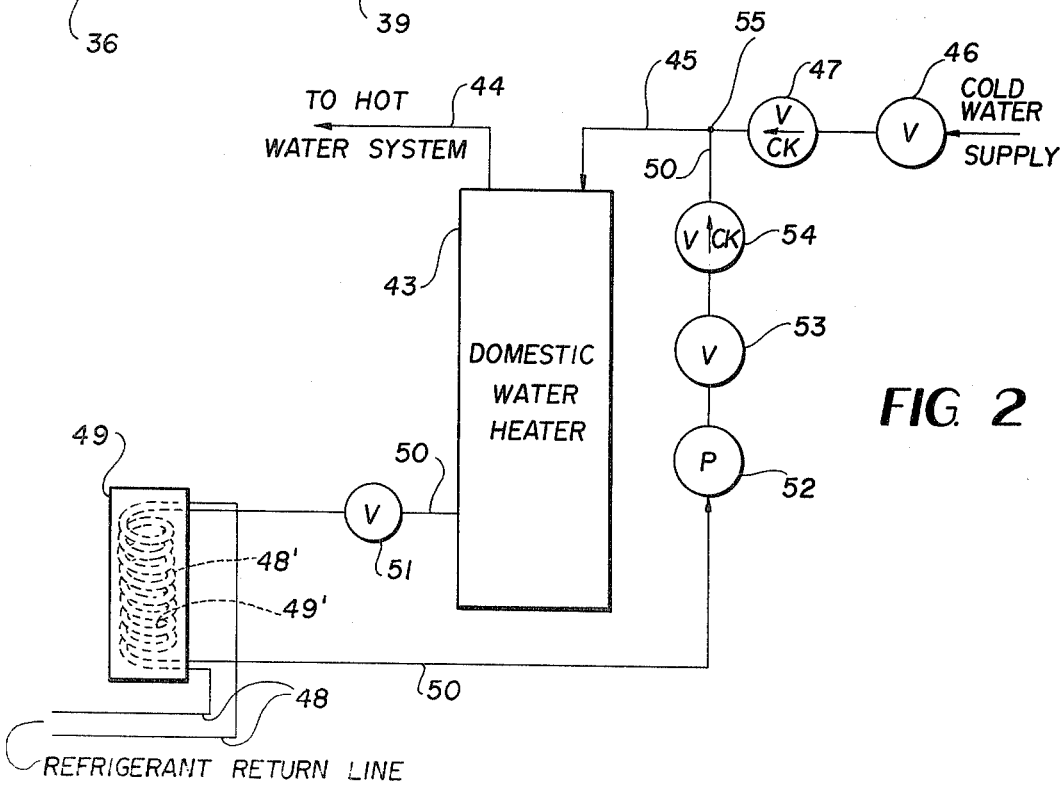
FIG. 2

ENERGY CONSERVING WATER HEATING SYSTEM

BACKGROUND OF THE INVENTION

The current world-wide energy shortage has stimulated a need for more energy efficient domestic appliances of all kinds. This need is particularly critical in connection with heating systems for domestic hot water because such systems are among the heaviest consumers of energy on a year round basis.

The present invention seeks to satisfy the need for an energy conserving domestic water heating system by recovering and utilizing heat which heretofore has been wasted into the atmosphere through the furnace flue and/or the warm air outlet of the air conditioning condenser unit. In a variant of the invention, heat is recovered from the return line for hot refrigerant in an air conditioning unit and is utilized through a heat exchange means in the domestic water heating system.

The system embodying the invention also employs a circulating pump which is controlled through a relay to a standard thermostat, whereby when the thermostat is calling for either heating or cooling the pump will be energized, and at other times the pump will be de-energized. By means of the invention, water which is preheated by utilization of normally wasted heat energy can be stored in the separate storage tank at a temperature in the range of 145°-165° F. and this preheated water will be injected into the inlet of the domestic water heater so that the latter may have its thermostat lowered from the usual 130°-140° F. to approximately 100°-110° F. The hot water heater is only required to work when the furnace or air conditioning unit is not running enough to supply all needed hot water, thus resulting in a very substantial savings on energy costs to the consumer.

The invention can be installed in either new or existing hot water heating systems on an economical basis and amortization is estimated to be three to five years on average.

The prior art contains a number of teachings relative to the recovery of waste heat energy and/or the use of heat exchanger means in conjunction with domestic water heaters. Generally, the prior art devices have been excessively costly to install and have not been compatible with existing equipment as is the case with the present invention. Furthermore, the known prior art devices do not possess the full capabilities of the invention in one simplified system for selectively utilizing wasted energy in the furnace flue or in air conditioning equipment through employment of a separate water storage tank, associated system valving, and a circulating pump as will be fully described in the following detailed description.

BRIEF DESCRIPTION OF THE DRAWINGS

FIG. 1 is a schematic view of an energy saving domestic water heating system embodying the invention.

FIG. 2 is a schematic view showing a variant of the invention.

DETAILED DESCRIPTION

Figure 3:
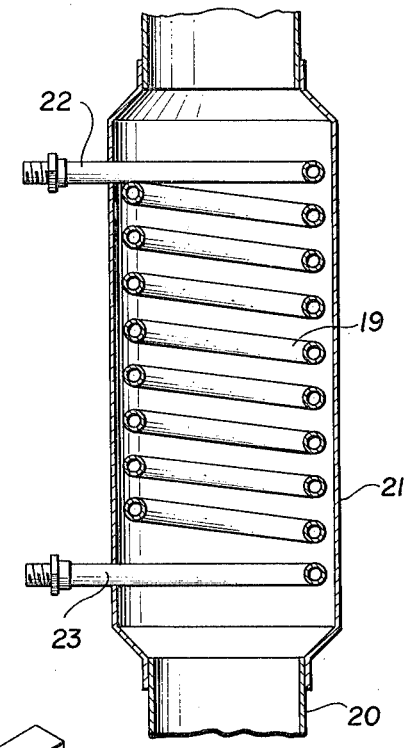
FIG. 3 is an enlarged central vertical cross section through a furnace flue heat exchanger coil forming a part of the system.

Referring to the drawings in detail, the numeral 10 in FIG. 1 designates a conventional domestic water heater having an outlet line 11 leading to points of use in the system, namely faucets. The numeral 12 designates a water inlet line for the heater 10 having a check valve 13 coupled therein, the inlet line 12 leading from and being connected to the outlet 14 of a separate water storage tank 15 utilized in the system. An inlet line 16 for cold water is connected with the storage tank 15 and contains a check valve 17 and a shut off valve 18 upstream from the tank 15.

The system shown in FIG. 1 further comprises a waste heat recovery coil 19 placed in heat exchange relationship with normally wasted hot gases in a furnace flue 20. In FIG. 3, the details of the coil 19 and its mounting are shown. The furnace flue 20 has an enlarged section 21 to receive the coil 19 and the section 21 may have a lining of thermal insulation, if desired. Inlet and outlet terminals 22 and 23 of the coil 19 are suitably supported on the flue section 21 and are coupled with system pipes or lines 24 and 25 as illustrated in FIG. 1.

An outlet line 26 near the bottom of the storage tank 15 has parallel branches 27 and 28 each equipped with a shut-off valve 29. The valve 29 coupled with the branch line 28 is also connected with the inlet line 24 of the recovery coil 19. Similarly, the outlet line 25 leading from the coil 19 is coupled to another shut-off valve 30 which in turn is connected to a line 31 leading to a system pump 32 and shut-off and check valves 33 and 34 immediately downstream thereof. Beyond the check valve 34, the line 31 is connected at 35 with the inlet line 12 of the water heater 10.

Figure 4:
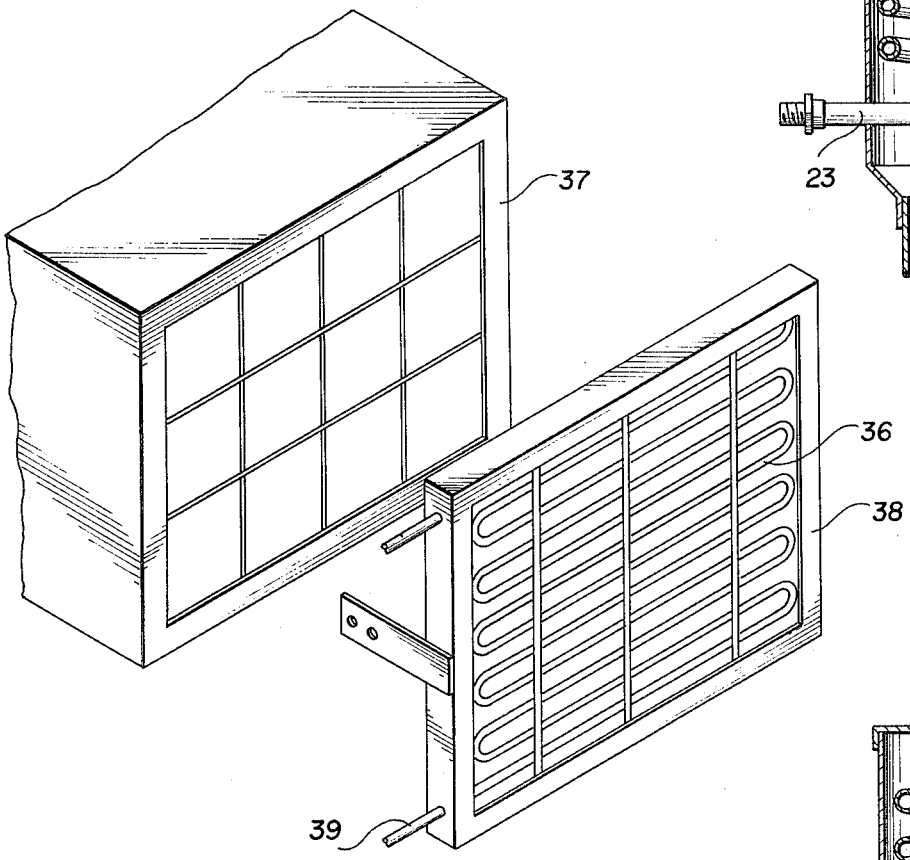
FIG. 4 is an exploded perspective view showing an air conditioner condenser unit and a heat exchanger coil used therewith and forming a part of the system.

The system utilizes a second heat exchanger or waste heat recovery coil 36 also shown in FIG. 4 positioned at the warm air outlet of an air conditioner condensing unit 37 where such is employed in the household. The coil 36 is held in a sturdy frame 38, FIG. 4, adapted to be interfaced with the condensing unit 37. A water inlet line 39 for the coil 36 leads from the shut-off valve 29 which is in series with the branch line 27. An outlet line 40 for the coil 26 contains a shut-off valve 41 connected by another line 42 with the line 31 downstream from the valve 30 and between it and the pump 32.

The complete system of FIG. 1 operates as follows:

Assuming that the household furnace is in operation and the air conditioning unit is not operating, the valve 41 and the valve 29 connected with the line 39 are closed to isolate the coil 36. All other valves of the system are open. When a faucet or faucets in the household are open to demand hot water, such water is delivered from the domestic heater 10 through the supply line 11 in the usual manner. However, as this occurs, stored preheated water at a temperature of about 105° from the tank 15 will be injected automatically through the lines 14 and 12, or 31 and 12, into the water heater 10. If the pump 32 is running under control of a conventional thermostat, not shown, calling for furnace heat, the following will occur. The pump 32 will draw water from the storage tank outlet 36 through branch line 28, open valve 29 and line 24, through heat exchange coil 19 and delivery line 25 and through the open valve 30 to the pump. This water which has taken heat from the furnace flue 20 passes through valves 33 and 34 and valve 13 and through the line 12 and into the water heater 10 which can be operated at a low setting, such as 90° in view of the recovery of normally wasted heat from the furnace flue 20.

On the other hand, if the thermostat controlling the pump 32 is not calling for furnace heat, the pump will remain shut off. In this situation, when water is demanded at hot water faucets of the system, preheated water from the tank 15 will flow out through the line 14 and through check valve 13 and inlet line 12 to the water heater 10 and the heater will deliver water to the particular faucets through the supply line 11. Thus, in any situation, the system will consume less energy than a conventional system because the recovered heat energy from the flue 20 is being utilized either directly when the pump 32 is energized, or indirectly when the pump is de-energized, as explained above.

Under conditions where the air conditioning system is in operation and the furnace is shut down, the valve 30 and the valve 29 connected with the branch line 28 are closed and the other systems valves are open. With the pump 32 running, water is taken from the storage tank outlet 26 and passes through branch line 27, associated valve 29, waste heat recovery coil 36, line 40, valve 41, lines 42 and 31, pump 32 and valves 33, 34 and 13 and into the domestic water heater 10 in substantially the same way that the system operates to utilize heat recovered by the coil 19, as previously described. When the thermostat controlling the pump 32 is not calling for cooling and the air conditioning unit is "off", the pump 32 will also be "off". In this case, hot water demanded at system faucets will be delivered from the water heater 10 in the usual manner, but simultaneously, stored preheated water in the tank 15 will be injected through lines 14 and 12 into the water heater 10 in the same manner described previously relative to the flue coil 19.

It should now be apparent that the system possess versatility of operation in that it can be selectively operated by the proper adjustment of a few shut-off valves to recover normally wasted heat from the flue 20 or from the outlet of air conditioning condenser 37. As a practical matter, the furnace and air conditioning system should not be in operation simultaneously, but were this to occur and with all of the valves 29, 30 and 41 open, the waste heat recovered through both coils 19 and 36 would be usable simultaneously in the system.

Figure 5:
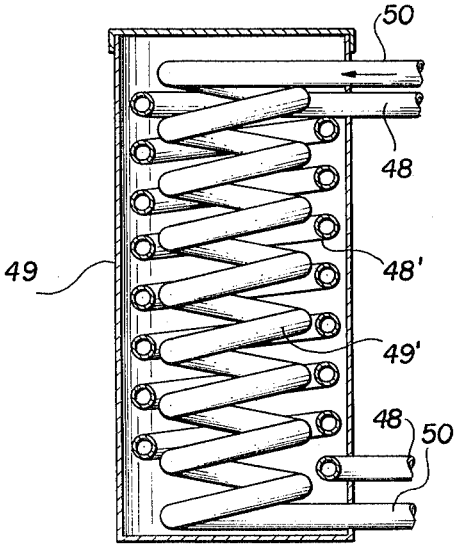
FIG. 5 is a vertical section showing a heat exchanger unit in which a hot gas refrigerant return line is formed as a coil surrounding a coil formed in the water line leading from the lower portion of a domestic water heater.

In FIGS. 2 and 5, a simplified variation of the system is illustrated. Such a system is suitable where a household is heated and cooled by operation of a heat pump and does not employ a furnace or furnace flue. In the modified system, a domestic water heater 43 has an outlet line 44 leading to system hot water faucets and has a water inlet line 45 leading from a cold water supply through a cold water shut-off valve 46 and serially connected to a check valve 47. A hot refrigerant gas return line 48 of an air conditioner or heat pump is formed into a coil 48' inside of a cylindrical housing 49 in heat exchange relationship with an interior coil 49' formed in a water line 50 leading from the lower portion of water heater 43, and equipped upstream of the coil 49' with a shut-off valve 51.

Beyond the heat recovery coil 49', the line 50 is extended to a thermostatically controlled pump 52, serially connected with a shut-off valve 53 and check valve 54. Beyond this point, the line 50 is coupled at 55 into the water inlet 45 of the heater 43, downstream of check valve 47. As in the first embodiment of the invention, the circulating pump 52 is controlled through a relay by the standard air conditioning or heat pump thermostat, not shown. When this thermostat is calling for cooling, the pump 52 will be running. Water from the heater 43 will be drawn through the line 50 and through the heat extraction coil 49' of heat exchanger 49, which coil is in heat exchange relationship with the surrounding hot refrigerant coil 48'. After taking heat from the hot refrigerant coil 48', the preheated water continues to flow through line 50, pump 52, valves 53 and 54, and into line 45 to the top of water heater 43, enabling the latter to have its control thermostat adjusted to a much lower than normal setting, such as 95° F. Thus, in a general sense, the system in FIGS. 2 and 5 accomplishes the same objectives of conserving energy as the more complete system of FIG. 1. The advantages of the invention should now be apparent to those skilled in the art.

It is to be understood that the forms of the invention herewith shown and described are to be taken as preferred examples of the same, and that various changes in the shape, size and arrangement of parts may be resorted to, without departing from the spirit of the invention or scope of the subjoined claims.

We claim:

1. An energy conserving water heating system comprising a primary water heater having a cold water inlet and a hot water outlet, a water storage tank located upstream from the primary water heater and having a first outlet connected with the inlet of the primary water heater and a second outlet, a furnace flue associated heat exchanger including a water inlet having a connection with the second outlet of said water storage tank and also having an outlet, pump means connected between the last-named outlet and the primary water heater inlet and between such inlet and said first outlet of the water storage tank, another heat exchanger associated with the outlet of an air conditioning condenser and having an inlet connected with the second outlet of the water storage tank and having an outlet connected with the pump means between such means and the outlet of said flue associated heat exchanger, and valve means connected between the second outlet of the water storage tank and the respective inlets of the first and second named heat exchangers and between the outlets of such heat exchangers and the pump means.

2. An energy conserving water heating system as defined in claim 1, and the outlets of the first and second named heat exchangers being connected to the pump means through a common line leading to the inlet of the pump means, and additional valve means connected between the pump means and the primary water heater inlet.

* * * * *